United States Patent [19]

D'Errico

[11] Patent Number: 4,948,056

[45] Date of Patent: Aug. 14, 1990

[54] COLLOID MILL WITH COOLED ROTOR

[76] Inventor: Edward D'Errico, 4465 Douglas Ave., Bronx, N.Y. 10471

[21] Appl. No.: 300,308

[22] Filed: Jan. 23, 1989

[51] Int. Cl.[5] ..... B02C 23/18

[52] U.S. Cl. ..... 241/67; 241/261.1

[58] Field of Search ..... 241/65, 66, 67, 172, 241/260, 261.1

[56] References Cited

U.S. PATENT DOCUMENTS

| | | | |
|---|---|---|---|
| 1,851,071 | 3/1932 | Travis | 241/67 X |
| 2,402,170 | 6/1946 | Lund | 241/67 X |
| 3,398,900 | 8/1968 | Guba et al. | 241/67 |
| 4,174,074 | 11/1979 | Geiger | 241/67 X |

*Primary Examiner*—Mark Rosenbaum
*Attorney, Agent, or Firm*—Richard L. Miller

[57] ABSTRACT

A colloid mill includes a rotor turning relative to a fixed stator with a narrow passageway therebetween through which a slurry is passed to produce a fine colloid. A cooling fluid is passed through a hollow annular passageway within the stator to cool the stator and the slurry adjacent thereto. A cooling fluid is also passed through an input tube in the center of the rotor shaft, then through a hollow annular passageway within the rotor, to cool the rotor and the slurry adjacent thereto. The rotor cooling fluid exits the rotor through an annular exit passageway between the rotor shaft and the input tube.

5 Claims, 1 Drawing Sheet

COLLOID MILL WITH COOLED ROTOR

BACKGROUND OF THE INVENTION

1. Field of the invention:

This invention relates to colloid mills having an enclosure in which a rotor turns relative to a stator and wherein a slurry passes between the elements to produce a fine colloid. A cooling fluid is provided to both the stator and rotor through annular passages therein to avoid problems with excessive heating of the mechanical elements as well as the slurry itself.

2. Description of the Prior Art:

A number of industries require milling to refine a product to increase its utility. Typical products are foodstuffs, paints, toiletries and pharmaceuticals. Early mills mixed the product to be refined with pebbles or balls, and rotated the mixture such that the pebbles or balls crush and mix the solid particles. Other mills use rollers, generally in pairs, through which the slurry is passed and crushed or ground. More recently colloid mills have been developed which use a rotor turning relative to a stator with the slurry to be milled continuously passing through the narrow space between the rotor and stator. The rotor smears a thin film of the slurry on the cooperating stator face and the hydraulic shear effect produced by the interaction of the two elements produces emulsions characterized by particle sizes ranging down to submicron.

To produce small particle sizes it is necessary to make the space between the rotor and stator quite narrow, and/or to drive the rotor at relatively high speeds. With increased speed and shearing force, slippage of the slurry occurs and undesired heat builds up. For some products, particularly chemical and biological products, heat is destructive, and heat is always detrimental to seals and precision mechanical elements.

It has been suggested in the prior art to prevent heating problems by cooling the colloid mill. For example, in U.S. Pat. No. 3,814,334 to Funk, a colloid mill of the type that uses pebbles or balls is supplied with a cooling jacket around the rotating elements. U.S. Pat. No. 3,788,565 to Adams injects a flush fluid to protect and cool a mechanical seal for the rotor shaft of a colloid mill. And U.S. Pat. No. 4,113,189 to Sullivan states that heat problems in conventional colloid mills are often avoided by increasing the gap between the rotor and stator, which has the undesirable result of reducing the efficiency of the mill and the amount of refining that occurs, or by cooling the rotor, the stator, or both, although no means is shown to accomplish the cooling.

It is also known to be common practice to provide a cooling fluid to cool the stator of rotating devices such as colloid mills.

It is an object of the present invention to provide improved cooling to conventional colloid mills to prevent unnecessary and detrimental heating of the colloid mill elements as well as the slurry passed therethrough.

A further object of the present invention is a novel system and apparatus for cooling the rotor of a colloid mill.

A still further object of the present invention is an improved cooling system for colloid mills in which a cooling fluid is supplied continuously to both the rotor and stator during operation thereof.

SUMMARY OF THE INVENTION

In accordance with a preferred embodiment of the present invention there is provided a colloid mill having a rotor turning relative to a stator, and a slurry passing through a narrow passageway between the elements for milling thereof. A first cooling fluid is fed from a source into an annular passageway within the stator to provide cooling to the stator and to the slurry passing through the passageway adjacent to the stator. A second cooling fluid, which may be the same as the first cooling fluid, is fed through an input conduit or tube extending axially through the center of the rotor drive shaft. The second cooling fluid passes through holes in the input conduit and in the rotor shaft into an annular passageway in the inside of the rotor, thereby cooling the rotor element as well as the slurry adjacent thereto. The second cooling fluid returns to its source through an annular passage formed between the input tube and the inner wall of the rotor shaft. Means may be provided to vary the flow rate and/or the temperature of the cooling fluids to control the cooling supplied to each element independently.

BRIEF DESCRIPTION OF THE DRAWINGS

The FIGS. in the drawings are briefly described as follows.

DETAILED DESCRIPTION OF THE PREFERRED EMBODIMENT

Figure 1:
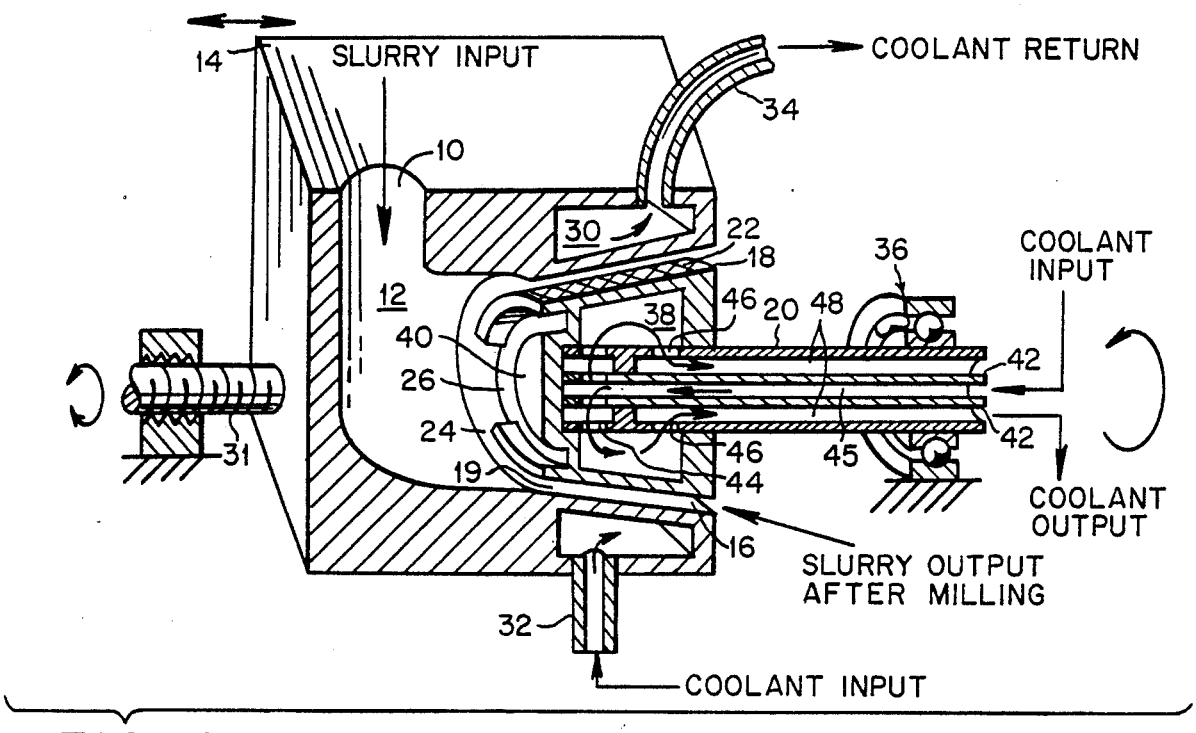
FIG. 1 is a fragmentary schematic diagram, partially in perspective, of the preferred embodiment of the present invention; and, FIG. 2 is a side elevation, in cross-section, of a typical embodiment of the present invention.
Figure 2:
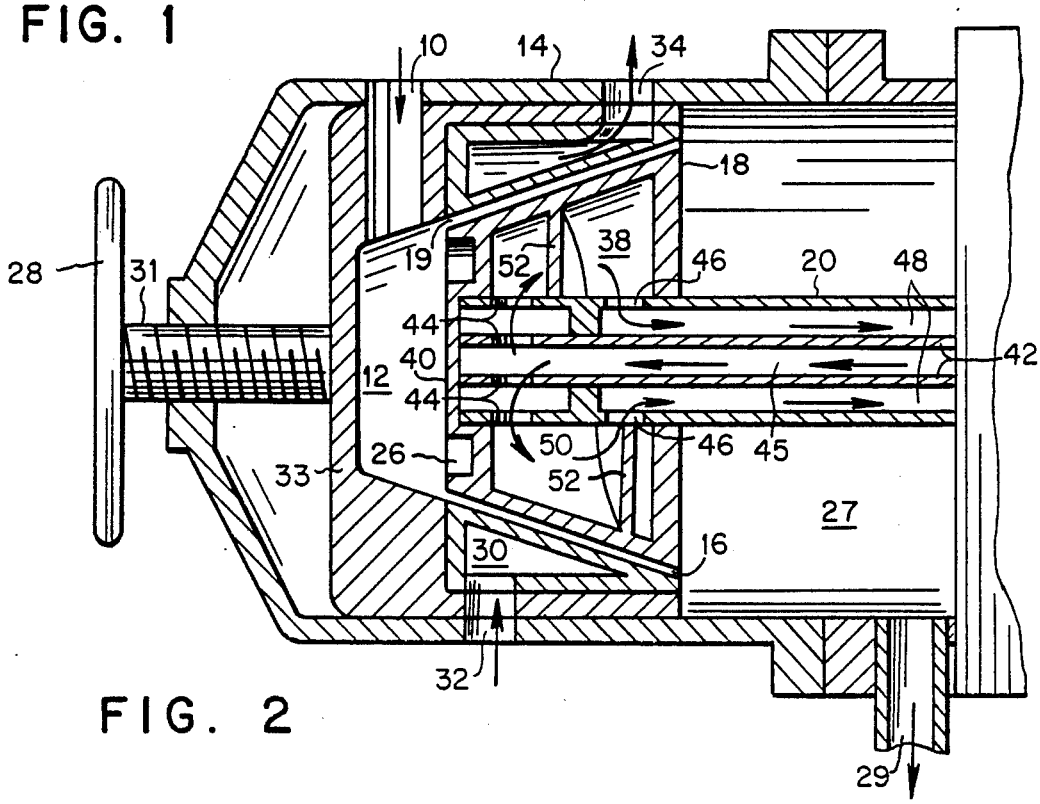

Colloid mills are used in many industries to produce stable emulsions down to the submicron range. Solids and/or liquids are dispersed into a carrying vehicle and the resulting slurry is passed through the colloid mill. Any emulsion or suspension, liquids in liquids or solids in liquids, may be milled with a particle size accuracy and distribution dependent on the particular colloid mill. Some mills recirculate the product until samples indicate that the product is ready for discharge, whereas others are used as part of a continuous in-line processing system. Referring to FIGS. 1 and 2, there is shown a representative colloid mill adapted to practice the invention. FIG. 1 shows the main concepts of the invention schematically, whereas FIG. 2 shows a representative construction of the invention in cross-section. Like reference numerals in both FIGS. refer to the same elements. The slurry to be milled is fed through an input port 10 into an enclosure 12 within a casing 14. Within casing 14 downstream from port 10 there is located a concave shaped stator 16 connected to the inner wall of casing 14, the stator 16 extending circumferentially about the inside of the casing 14. While not shown, the stator 16 is preferably channeled or striated about its circumference, the striations being parallel to the central axis of the stator, with the edges of the striations being sharpened to act like teeth in order to macerate the slurry passing thereby.

A rotor 18 shaped in the form of a truncated cone is positioned adjacent to stator 16, the outside walls of rotor 18 and stator 16 being separated by an adjustably small passageway 19 to provide a path for the slurry. Shearing action produced by the construction of the stator and rotor walls produces the desired milling to the slurry passing through the passageway 19.

Rotor 18 is attached via an axially extending hollow shaft 20 to a drive means, not shown, which provides to shaft 20 and rotor 18 adjustable speed rotary motion. The rotor 18 preferably contains a number of narrow channels or serrations 22 on its outside surface which form a plurality of teeth, shown in FIG. 1 as diamond shaped, which enhance the shearing action between the stator and rotor.

The upstream end of the rotor may have turbine-type blades, not shown, extending from the upstream end wall 40 of the rotor into enclosure 12 to subject the unrefined slurry therein to a high velocity whirling action and premixing via centrifugal force. As shown only in FIG. 1, the upstream end of the rotor 18 may contain several raised sectors 24 about its outside circumference. A circumferential channel or recess 26 extends about the end wall 40 of rotor 18 and in contact with the slurry in enclosure 12. The purpose of sectors 24 and channel 26 is to produce a geometry which enhances premixing of the slurry before it passes through passageway 19.

As the slurry enters narrow passageway 19, the shearing action described previously occurs resulting in milling of the particles in the slurry. The milled slurry is thereupon thrown by high centrifugal forces from the downstream end of passageway 19 into a collecting chamber 27 as shown in FIG. 2. The milled slurry is removed from chamber 27 via outlet 29.

The gap in passageway 19 between stator 16 and rotor 18 may be increased or decreased by turning a hand wheel 28 which actuates a worm gear 31 causing outside wall 33 (FIG. 2) of chamber 12 and attached stator 16 to move axially relative to rotor 18. The rotor 18 is preferably fixed in position. Only slight motion is permitted due to the narrowness of passageway 19 since a very slight axial movement of the stator 16 will produce a significant change in the dimension of passageway 19.

Rotor shaft 20 may be supported as shown in FIG. 1 by a conventional roller bearing assembly 36. The assembly 36, as well as the remainder of the colloid mill construction except for the rotor and stator cooling construction described subsequently are conventional and well known in the art, and will not be described in detail.

A hollow annular passageway or opening 30 is located in the center of stator 16, with an inlet port 32 and an outlet port 34 communicating therewith through casing 14. A first source of cooling fluid, not shown, which may be cool water or a refrigerant gas, or any other noncorrosive fluid, is connected to feed the cooling fluid into passageway 30 via inlet port 32, and the fluid is returned to the source via outlet port 34 after circulating through opening and cooling stator 16 as well as the slurry in contact with the stator 16. The pressure and /or temperature of the coolant fluid may be varied to control the amount of cooling provided.

Another novel aspect of the present invention is the provision of cooling means for the rotor 18. The inside of rotor 18 contains a substantially annular passageway 38 which has a spiral auger member 52 axial aligned with the axis of rotation of the rotor. The spiral auger member 52 is twisted in the direction to help assist coolant through the rotor and at the same time lends it self to transferring heat more efficiently from the rotor to the cooling fluid. Rotor shaft 20 is tubular, and fixedly connected at its upstream end to the inside of the wall 40 of rotor 18. Contained within rotor shaft 20 and axial therewith is a hollow conduit 42 also fixedly attached to the inside of wall 40. A plurality of small holes 44 are located in both the upstream end of conduit 42 and in the upstream end of rotor shaft 20, the holes 44 being in communication with passageway 38. Cooling fluid from a source, not shown, but which may be the same source for the fluid supplied to passageway 30 in stator 16, is fed through a fluid communicating rotatory coupling joint (also not shown but well known in many arts) into the passage 45 in the center of conduit 42, then through holes 44 and into passageway 38 to provide cooling to rotor 18 as well as to the slurry passing along the outside wall of rotor 18. The cooling fluid then passes through holes 46 located in the wall of rotor shaft 20 downstream of holes 44, and into the annular outlet passage 48 formed between the outer wall of conduit 42 and the inner wall of rotor shaft 20. The coolant fluid is then returned to its source through an appropriate fluid communicating rotatory coupling joint. To prevent the cooling fluid from returning from inlet passage 45 directly into outlet passage 48 without passing through rotor passageway 38, a solid annular ring 50 is positioned in passageway 48. As with the cooling fluid provided to stator 16, the coolant fluid for the rotor 18 may be varied in pressure and/or temperature to give optimum cooling to the rotor 18.

While the invention has been described with reference to a preferred embodiment thereof, it will be apparent to those skilled in the art that changes maybe made to the construction and arrangement of the components without departing from the scope of the invention as hereinafter claimed.

What is claimed is:

1. A colloid mill comprising: a stator with a milling face, a rotor formed as a frusto-conical shell having its conical wall surface positioned immediately adjacent to said stator milling face and adapted for rotation relative thereto, so that a substantially annular passage is defined between said stator face and said conical surface through which a slurry is passed for milling;

inlet and outlet means for slurry, located, respectively, forwardly and rearwardly of the rotor:

the rotor shell having front and rear walls extending transversely thereof:

a tubular rotary shaft extending in sealing engagement through the rear wall into the rotor and being fixed at a front end to the front wall thereby to support the rotor and defining with the rotor an annular coolant chamber;

a coolant fluid inflow conduit mounted coaxially within the tubular shaft thereby defining a space between said conduit and said tubular shaft forming a coolant fluid outflow;

a first plurality of coolant inflow holes in said conduit and in said tubular shaft communicating with said annular chamber at a location adjacent the front wall;

a second plurality of coolant outflow holes in said tubular shaft communicating with said annular chamber at a location adjacent the front wall;

a second plurality of coolant outflow holes in said tubular shaft communicating with said annular chamber at a location adjacent the rear wall; and, a solid annular ring in said duct between said first plurality of coolant inflow holes and said second plurality of coolant outflow holes arranged to prevent coolant fluid flowing directly along the shaft from the coolant inflow holes to the coolant outflow holes.

2. A colloid mill as in claim 1, the further improvement comprising:

(a) a circumferentially extending opening located adjacent to and in heat exchange relation with said stator; and, (b) means communicating with said opening for conducting a cooling fluid therethrough.

3. A colloid mill as in claim 2, the improvement in which said means communicating with said opening comprises:

(a) a first conduit extending into said opening for passing a cooling fluid into said opening; and, (b) a second conduit extending into said opening for removing a cooling fluid from said opening.

4. A colloid mill as in claim 1, further comprising a spiral auger member fixedly secured within said annular chamber extending between the conical wall and the tubular rotor shaft and between the first and second pluralities of coolant inflow holes and the second plurality of coolant outflow holes for assisting the flow of coolant fluid through said rotor and improving the heat transfer characteristic between said coolant fluid and said rotor.

5. A colloid mill comprising a stator with a milling face, a rotor formed as a frustoconical shell having its conical wall surface positioned immediately adjacent to said stator milling face and adapted for rotation relative thereto, so that a substantially annular passage is defined between said stator face and said conical surface through which a slurry is passed for milling;

inlet and outlet means for slurry, located, respectively, forwardly and rearwardly of the rotor;

means for moving the stator axially relative to the rotor shell thereby to vary the radial width of the passageway;

the rotor shell having front and rear walls extending transversely thereof;

a tubular rotary shaft extending in sealing engagement through the rear wall into the rotor and being fixed at a front end to the front wall thereby to support the rotor defining with the rotor an annular coolant chamber;

a coolant fluid inflow conduit mounted coaxially within the tubular shaft thereby defining a space between said conduit and said tubular shaft forming a coolant fluid outflow;

a first plurality of coolant inflow holes in said conduit and in said tubular shaft communicating with said annular chamber at a location adjacent the front wall;

a second plurality of coolant outflow holes in said tubular shaft communicating with said annular chamber at a location adjacent the rear wall;

a solid annular ring in said duct between said first plurality of coolant inflow holes and said second plurality of coolant outflow holes arranged to prevent coolant fluid flowing directly along the shaft from the coolant inflow holes to the coolant outflow holes; and, a spiral auger member fixedly secured within said annular chamber extending between the conical wall and the tubular rotor shaft and between the first and second pluralities of coolant inflow holes and the second plurality of coolant outflow holes for assisting the flow of coolant fluid through said rotor and improving the heat transfer characteristic between said coolant fluid and said rotor.

* * * * *